US011841661B2

(12) United States Patent
Hirota

(10) Patent No.: US 11,841,661 B2
(45) Date of Patent: Dec. 12, 2023

(54) IMAGE FORMING APPARATUS INCLUDING A CONVEYANCE PATH TO GUIDE A SHEET TO BE REVERSELY CONVEYED TO A DISCHARGE CONVEYANCE PATH

(71) Applicant: CANON KABUSHIKI KAISHA, Tokyo (JP)

(72) Inventor: Kenichi Hirota, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/710,102

(22) Filed: Mar. 31, 2022

(65) Prior Publication Data

US 2022/0326649 A1 Oct. 13, 2022

(30) Foreign Application Priority Data

Apr. 13, 2021 (JP) ..... 2021-067582

(51) Int. Cl.
*G03G 15/00* (2006.01)

(52) U.S. Cl.
CPC ..... *G03G 15/5062* (2013.01); *G03G 15/55* (2013.01)

(58) Field of Classification Search
CPC ..... G03G 15/5062
USPC ..... 358/2.1
See application file for complete search history.

(56) References Cited

U.S. PATENT DOCUMENTS

| | | | | |
|---|---|---|---|---|
| 9,213,293 | B2 | 12/2015 | Tajima | |
| 2007/0041762 | A1* | 2/2007 | Ishida | G03G 15/6564 399/388 |
| 2014/0185047 | A1* | 7/2014 | Tajima | G03G 15/5062 356/402 |
| 2020/0089150 | A1* | 3/2020 | Tokuma | B65H 29/14 |
| 2021/0365752 | A1* | 11/2021 | Mori | G06K 15/16 |

FOREIGN PATENT DOCUMENTS

| | | | |
|---|---|---|---|
| JP | 2005221582 | A | 8/2005 |
| JP | 2013054324 | A | 3/2013 |
| JP | 2014131205 | A | 7/2014 |

* cited by examiner

*Primary Examiner* — Jacky X Zheng
(74) *Attorney, Agent, or Firm* — ROSSI, KIMMS & McDOWELL LLP

(57) ABSTRACT

An image forming apparatus includes an image forming unit configured to form an image on a sheet, a discharge conveyance path configured to discharge the sheet on which the image is formed by the image forming unit to outside, a reverse conveyance path configured to reverse a conveyance direction of the conveyed sheet and convey the sheet, a first conveyance path configured to guide the sheet conveyed from the image forming unit to the reverse conveyance path, a second conveyance path configured to guide the sheet reversed in the reverse conveyance path from the reverse conveyance path to the discharge conveyance path, and a reading unit configured to read the image of the sheet in the second conveyance path.

9 Claims, 10 Drawing Sheets

FIG.4

Header :

size : 270176 bytes
CMMType : 'appl'
version: 0x02002001
profileClose : 'prtr'
dataColorSpace: 'CMYK'
interchangeSpace: 'XYZ'
CreationDate: 3.4.1996, 19:46:14
CS23ignature : 'ascp' prim.platform : 'APPL'
flags : 0x00000000
deviceManufacturer : 'EF1'
deviceModel : 0
deviceAttributes : 0x00000000, 0x00000000
renderingIntent : 2
white XYZ : X=0.9642, V=1.0000, Z=0.8249

Tag Table : <10 e lements, double-click to inspect>

| Ind | Signet. | elementoffset | size |
|---|---|---|---|
| 0 | 'A2B0' | 252=0x000000FG | 43002 |
| 1 | 'A2A0' | 43256 = 0x0000A8F8 | 42940 |
| 2 | 'A2B1' | 86196 = 0x00015084 | 43002 |
| 3 | 'B2A1' | 129200 = 0x0001F880 | 42940 |
| 4 | 'A2B2' | 172140 = 0x0001A06G | 43002 |
| 5 | 'B2A2' | 215144 = 0x00034868 | 42940 |
| 6 | 'gamt' | 258084 = 0x0003F024 | 11925 |
| 7 | 'desc' | 270012 = 0x00041EBG | 125 |
| 8 | 'cprt' | 270140 = 0x00041F3G | 14 |
| 9 | 'wtpt' | 270156 = 0x00041F4G | 20 |
| | | | |
| | | | |
| | | | |
| | | | |
| | | | |
| | | | |

IMAGE FORMING APPARATUS INCLUDING A CONVEYANCE PATH TO GUIDE A SHEET TO BE REVERSELY CONVEYED TO A DISCHARGE CONVEYANCE PATH

BACKGROUND OF THE INVENTION

Field of the Invention

The present invention relates to an image forming apparatus including an image reading unit that reads an image on a sheet.

Description of the Related Art

Conventionally, in an image forming apparatus such as a printer or a multifunction peripheral that forms an image on a sheet, there has been proposed an image forming apparatus that reads an image formed on a sheet and uses a result thereof for correction in next image formation. In an image forming apparatus described in JP 2005-221582 A, a reading unit that reads a position of an image formed on a sheet is provided in a duplex conveyance path for reversing the sheet on which an image is formed on one side and re-conveying the sheet to an image forming unit, and an image forming position of a next sheet is corrected. Further, in the image forming apparatuses described in JP 2013-54324 A and JP 2014-131205 A, a color sensor is disposed on a conveyance path between an image forming unit and a reverse portion that reverses a sheet, a patch image of the sheet is read by the color sensor to create a profile, and color adjustment is performed based on the profile.

For example, in a case where the reading unit is disposed in the duplex conveyance path as disclosed in JP 2005-221582 A, the sheet to be discarded is re-conveyed to the image forming unit and caused to pass therethrough, and thus the conveyance time until the sheet is discharged becomes long, and the time as the adjustment process becomes long in the first place. In addition, for example, in a case where the reading unit is disposed in front of the reverse portion as in JP 2013-54324 A and JP 2014-131205 A, when sheets are read continuously, it is necessary to widen the interval between the sheets so that the next sheet does not interfere with the sheet being read, and the time as the adjustment process also becomes long.

SUMMARY OF THE INVENTION

Therefore, the present invention provides an image forming apparatus capable of preventing the time of a process of reading images of a plurality of sheets from becoming long.

According to one aspect of the present invention is an image forming apparatus including an image forming unit configured to form an image on a sheet, a discharge conveyance path configured to discharge the sheet on which the image is formed by the image forming unit to outside, a reverse conveyance path configured to reverse a conveyance direction of the conveyed sheet and convey the sheet, a first conveyance path configured to guide the sheet conveyed from the image forming unit to the reverse conveyance path, a second conveyance path configured to guide the sheet reversed in the reverse conveyance path from the reverse conveyance path to the discharge conveyance path, and a reading unit configured to read the image of the sheet in the second conveyance path.

Further features of the present invention will become apparent from the following description of exemplary embodiments with reference to the attached drawings.

BRIEF DESCRIPTION OF THE DRAWINGS

FIG. 4 is a diagram for explaining an ICC profile.

DESCRIPTION OF THE EMBODIMENTS

Hereinafter, an image forming apparatus according to each embodiment will be described with reference to the drawings. The dimensions, materials, shapes, relative arrangements, and the like of the components described in the following embodiments are not intended to limit the scope of application of the present technology only to them unless otherwise specified.

Schematic Configuration of Image Forming Apparatus

Figure 1:
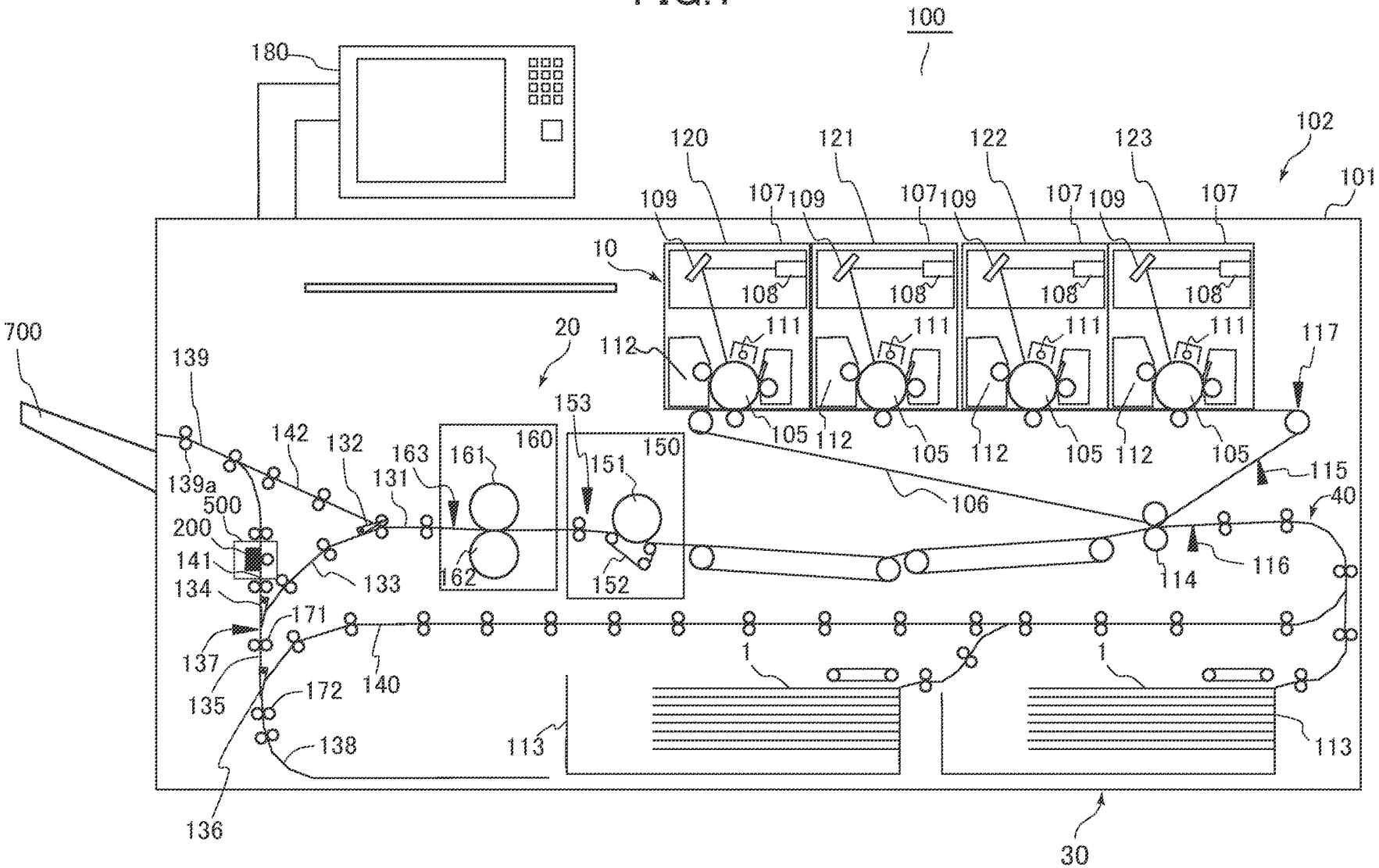
FIG. 1 is a schematic diagram of an image forming apparatus according to a present embodiment.

FIG. 1 is a schematic diagram illustrating an image forming apparatus 100 according to a present embodiment. In the present embodiment, the image forming apparatus 100 which is an electrophotographic laser beam printer will be described as an example of the image forming apparatus, but the present invention is not limited thereto, and the image forming apparatus may be an inkjet printer or a sublimation printer.

A casing 101 of the image forming apparatus 100 is mounted with an image forming engine 102 and a control board storage portion (not illustrated) that houses a printer controller 103 (see FIG. 3) that is a control unit for controlling the operation of the image forming apparatus 100. The image forming engine 102 as an image forming unit includes an optical processing mechanism 10 and a fixing processing mechanism 20 that form an image on a recording material by an image forming process, and a feed processing mechanism 30 and a conveyance processing mechanism 40 that feed and convey a rectangular sheet 1 used as a recording material. As the recording material, a sheet of paper such as plain paper or thick paper, paper subjected to surface treatment such as coated paper or embossed paper, plastic film, cloth, or the like can be used.

The optical processing mechanism 10 includes stations 120,121,122, and 123 that form toner images of respective colors of yellow, magenta, cyan, and black, and an intermediate transfer belt 106. In each station 120 to 123, a primary electrostatic charger 111 charges the surface of the photosensitive drum 105, which is a drum-shaped photosensitive member. The laser scanner unit 107 performs exposure process of the photosensitive drum 105 based on a command signal generated based on image data and transmitted to the laser scanner unit 107. The laser scanner unit 107 includes a laser driver that drives laser light emitted from a semiconductor laser (not illustrated) to turn on and off. The laser scanner unit 107 guides the laser beam from the semiconductor laser to the photosensitive drum 105 via the reflecting mirror 109 while distributing the laser beam in a main scanning direction (width direction of the sheet) by a rotating polygon mirror. As a result, an electrostatic latent image corresponding to the image data is formed on the surface of the photosensitive drum 105.

The developer 112 accommodates a developing agent containing toner therein, and supplies charged toner particles to the photosensitive drum 105. The toner particles adhere to the surface of the drum according to the surface potential distribution, whereby the electrostatic latent image carried on the photosensitive drum 105 is visualized as a toner image. The toner image carried on the photosensitive drum 105 is transferred (primarily transferred) to the intermediate transfer belt 106 to which a voltage having a polarity opposite to the normal charging polarity of the toner is applied. In the case of forming a color image, toner images formed by the four stations 120 to 123 are multiple-transferred so as to overlap each other on the intermediate transfer belt 106, whereby a full-color toner image is formed on the belt.

On the other hand, the feed processing mechanism 30 feeds the sheets 1 one by one from the sheet storage 113 inserted into the casing 101 of the image forming apparatus 100 in a drawable manner toward the transfer roller 114. The toner image carried on the intermediate transfer belt 106 which is an intermediate transfer member is transferred (secondarily transferred) to the sheet 1 by a transfer roller 114.

An image formation starts position detection sensor 115 for determining a print start position when an image is formed, a feeding timing sensor 116 for setting a feeding timing of the sheet 1, and a density sensor 117 are disposed on the periphery of the intermediate transfer belt 106. The density sensor 117 measures the density of the test patch image carried on the intermediate transfer belt 106. The printer controller 103 adjusts the operating conditions (for example, setting of the charging target potential of the primary electrostatic charger 111 and the bias voltage of the developer 112) of the optical processing mechanism 10 based on the detection result of the density sensor 117.

The fixing processing mechanism 20 of the present embodiment includes a fixing unit 150 and a cooling unit 160. The fixing unit 150 includes a fixing roller 151 for applying heat to the sheet 1, a pressure belt 152 for pressing the sheet 1 against the fixing roller 151, and a post-fixing sensor 153 for detecting completion of fixing process by the fixing unit 150. The fixing roller 151 is a hollow roller and includes a heater inside. The fixing unit 150 applies heat and pressure to the toner image on the sheet while nipping and conveying the sheet 1 by the fixing roller 151 and the pressure belt 152 which are a pair of rotary members. As a result, the toner particles are melted and then fixed, whereby the image is fixed on the sheet 1.

The cooling unit 160 is disposed on the downstream of the fixing unit 150 in the sheet conveyance direction, and is disposed for the purpose of lowering the temperature of the sheet 1 fixed by the fixing unit 150 to reduce the heat supply from the sheet 1 to the image forming portion and to reduce the curling amount of the product particularly at the time of double-sided printing. The cooling unit 160 includes a roller 161, a roller 162, and a post-cooling sensor 163 that detects completion of cooling process by the cooling unit 160. The cooling unit 160 nips the sheet 1 with a nip formed by the roller 161 and the roller 162 to transfer heat of the sheet 1 to the roller 161 and the roller 162. The heat transmitted to the roller 161 and the roller 162 is dissipated by a cooling fan (not illustrated).

The sheet 1 having passed through the cooling unit 160 is guided by a first switching flapper 132 (a second switching unit) from a conveyance path 131 to a discharge conveyance path 139 via a pre-discharge conveyance path 142 as a fourth conveyance path or to a pre-reverse conveyance path 133 as a first conveyance path. The sheet 1 carried into the pre-reverse conveyance path 133 passes through a second switching flapper 134 and is guided to the reversing conveyance path 135. The sheet 1 carried into the reversing conveyance path 135 is guided toward a standby path 138 by a first reverse conveyance roller 171 and/or a second reverse conveyance roller 172 as a reverse conveyance unit while the position of the sheet 1 is detected by a reverse sensor 137.

In the case of double-sided printing, the sheet 1 having an image formed on the front surface thereof is carried into the standby path 138 until a trailing edge thereof passes through a third switching flapper 136 (a first switching unit) based on detection by the reverse sensor 137. Then, a downstream end (leading edge) and an upstream end (trailing edge) of the sheet in the sheet conveyance direction are exchanged by switchback operation performed by the second reverse conveyance roller 172. In a state where the leading and trailing edges of the sheet are switched by the second reverse conveyance roller 172, the sheet is guided by the third switching flapper 136 toward the transfer roller 114 again via a re-conveyance path 140 as a third conveyance path, and an image is formed on a back surface of the sheet opposite to the front surface thereof.

Then, the sheet 1 on which the image formation in the single-sided printing has been completed or the sheet 1 on which the image formation in the back surface in the double-sided printing has been completed is guided to the discharge conveyance path 139 via the pre-discharge conveyance path 142. The sheet 1 conveyed to the discharge conveyance path 139 is discharged onto a discharge tray 700 provided outside the image forming apparatus 100 by a discharge roller 139*a* as a discharge unit.

On the other hand, when the sheet 1 that has passed through the cooling unit 160 is reversed and discharged (when a colorimetric job to be described later is executed), the sheet 1 having an image formed on the front surface thereof is guided to the pre-reverse conveyance path 133. Thereafter, based on the detection by the reverse sensor 137, the sheet is carried into the reversing conveyance path 135 and the standby path 138 until the trailing edge thereof passes through the second switching flapper 134. The reversing conveyance path 135 and the standby path 138 are reverse conveyance paths in the present embodiment. Then, a downstream end (leading edge) and an upstream end (trailing edge) of the sheet in the sheet conveyance direction are exchanged by switchback operation performed by the first reverse conveyance roller 171. The sheet 1 whose leading and trailing edges have been switched by the first reverse conveyance roller 171 is guided by the second switching flapper 134 to a post-reverse conveyance path 141 as a second conveyance path connecting the reversing conveyance path 135 and the discharge conveyance path 139, and is subsequently guided toward the discharge conveyance path 139. Then, the sheet 1 conveyed to the discharge conveyance path 139 after the front and back surfaces thereof are reversed in this manner is also discharged by the discharge roller 139*a* on the discharge tray 700 provided outside the image forming apparatus 100 in a state where the front and back surfaces thereof are reversed. That is, the post-reverse conveyance path 141 can also be said to be a conveyance path dedicated to discharge in a case where double-sided printing is not performed and the reversed sheet 1 is discharged.

Configuration of Color Sensor

Figure 2:
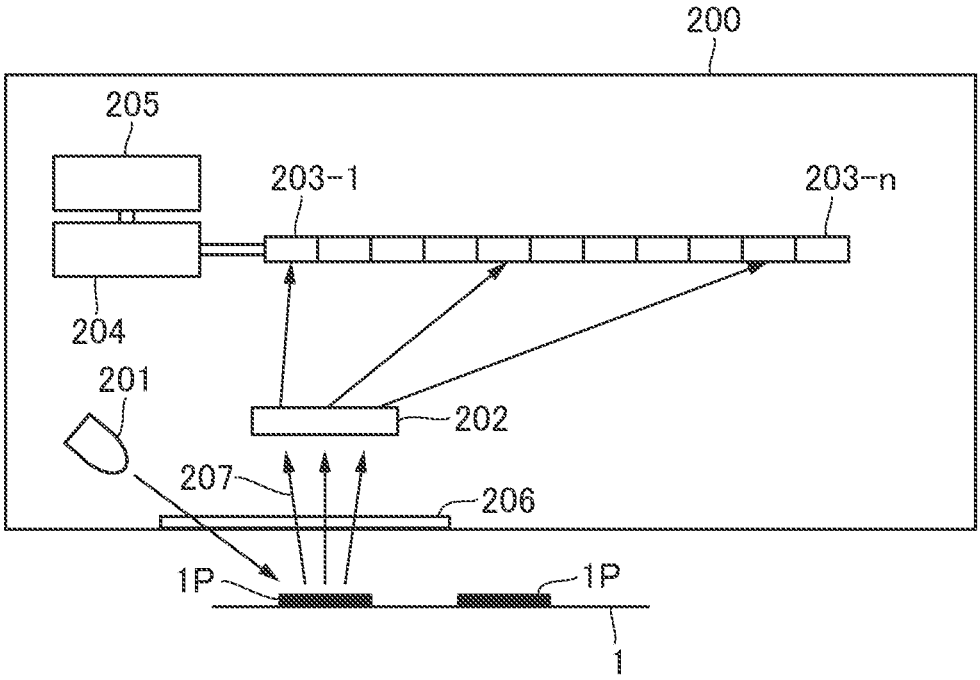
FIG. 2 is a schematic diagram illustrating a structure of a color sensor.

Next, the arrangement and structure of a color sensor 200 in a color measurement unit 500 will be described with reference to FIGS. 1 and 2. FIG. 2 is a schematic diagram illustrating a structure of the color sensor. The color measurement unit 500 that reads an image of the front surface of the reversed sheet 1 conveyed on the post-reverse conveyance path 141 is disposed along the post-reverse conveyance path 141 described above. The color measurement unit 500 includes a color sensor 200 as a reading unit that reads an image of the sheet 1.

As illustrated in FIG. 2, the color sensor 200 includes a white LED 201 that irradiates a patch image 1P including a large number of color patches formed as a test image on the sheet 1 with light, and a diffraction grating 202 that disperses light reflected from the patch image 1P for each wavelength. In addition, the color sensor 200 incorporates a lens 206 that condenses the light emitted from the white LED 201 on the patch image 1P on the sheet 1 and condenses the light reflected from the patch image 1P on the diffraction grating. In addition, the color sensor 200 is provided with a line sensor 203 (203-1 to 203-*n*) which is a CMOS sensor including n pixels that detect light decomposed for each wavelength by the diffraction grating 202. The color sensor 200 incorporates a calculation unit 204 that performs various calculations from the light intensity value of each pixel detected by the line sensor 203, and a memory 205 that stores various data. Note that the color measurement unit 500 includes an A/D converter, and transmits a color measurement result to the printer controller 103 in FIG. 3 by a digital signal.

Note that the pixel information of 1 to n of the line sensor 203 has the same relationship as the spectral wavelength. In order to finally output a detection result having a resolution of 10 nm from 380 to 780 nm, n=41 or more is desirable. In order to align the relationship between the wavelength and the pixel number, 48 pixels or 64 pixels are appropriate in consideration of an adjustment range or the like. Alternatively, a simple configuration is conceivable in which the number of pixels is reduced and the insufficient wavelength is calculated by interpolation operation. Such a simple configuration may be adopted, but the detection accuracy decreases.

Control Configuration of Image Forming Apparatus

Figure 3:
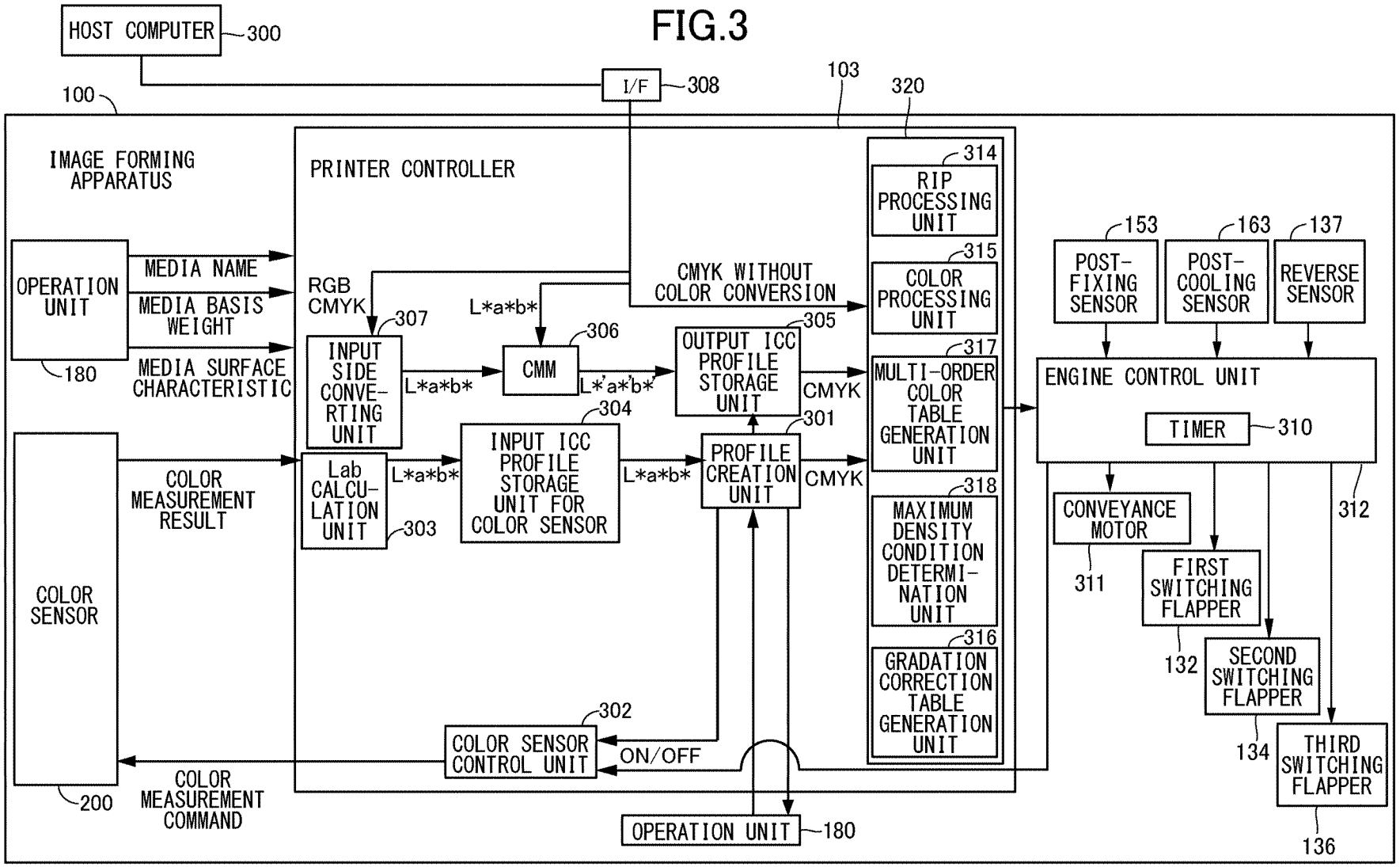
FIG. 3 is a block diagram illustrating a control configuration of the image forming apparatus.
Figure 5:
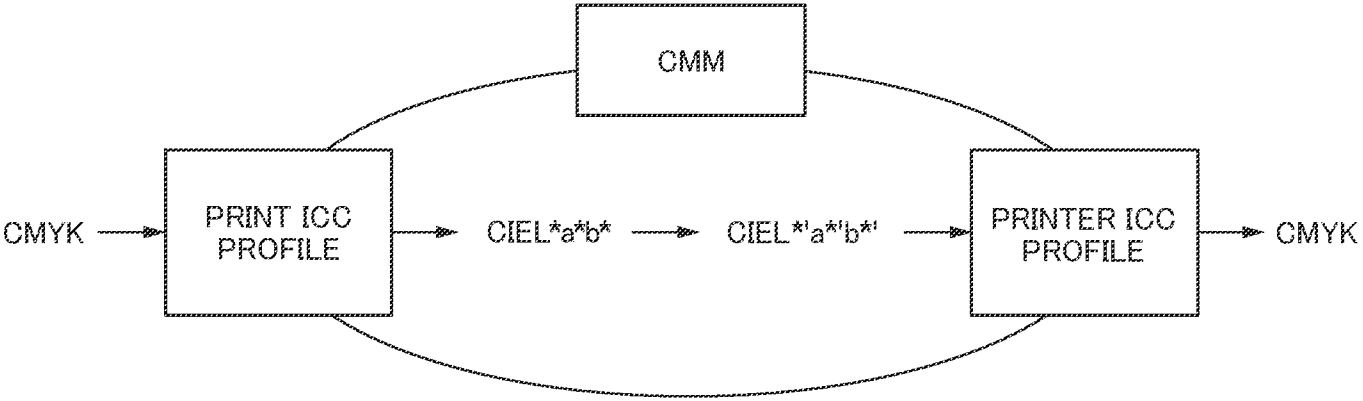
FIG. 5 is a schematic diagram illustrating a color management environment.

Next, control of the image forming apparatus 100 will be described with reference to FIGS. 3 to 5. FIG. 3 is a diagram illustrating a control configuration of the image forming apparatus, FIG. 4 is a diagram for explaining an ICC profile, and FIG. 5 is a schematic diagram illustrating a color management environment. A host computer 300 and the image forming apparatus 100 are connected by a communication line such as USB 2.0 High-Speed or LAN.

In the image forming apparatus 100, the printer controller 103 controls the overall operation of the printer. In addition, the printer controller 103 is connected to an I/F 308 that controls input/output to and from the host computer 300, an operation unit 180, the color sensor 200, and the engine control unit 312. In addition, the printer controller 103 includes a ROM 320 in which a control program and control data are incorporated together with a CPU and a RAM (not illustrated). Each control program of the ROM 320 constitutes a raster image processor (RIP) processing unit 314 that decompresses an image object into a bitmap image. In addition, each control program of the ROM 320 constitutes a color processing unit 315 that performs color conversion process of multi-order colors to be described later, a gradation correction table generation unit 316 that executes gradation correction of a single color, a multi-order color table generation unit 317 that reflects a correction result of the multi-order colors, and a maximum density condition determination unit 318.

The engine control unit 312 causes the image forming engine 102 to perform the above-described image forming process to form an image on a sheet based on a command signal from the printer controller 103 or the like. For example, the engine control unit 312 receives detection signals of the post-fixing sensor 153, the post-cooling sensor 163, and the reverse sensor 137. Then, based on these detection signals, the engine control unit 312 controls the operations of the conveyance motor 311 that drives the roller that conveys the sheet, the first switching flapper 132, the second switching flapper 134, and the third switching flapper 136.

The image forming apparatus 100 is provided with an operation unit 180 serving as a user interface (see FIG. 1). The operation unit 180 includes a display as a display unit that displays information to the user. In addition, the operation unit 180 includes, for example, physical keys such as a numeric keypad and a print execution button, and a touch panel function of a display as input unit by which the user can input commands and data to the image forming apparatus 100. By operating the operation unit 180, the user can input, to the printer controller 103, information indicating sheet attributes such as the name, grammage, and presence or absence of surface treatment of sheets set in a certain sheet storage 113 (see FIG. 1).

Color Adjustment in Image Formation

Next, the color adjustment of image formation when the color sensor 200 measures the color of the patch image 1P of the sheet 1 will be described in detail. That is, a flow of control for creating a color profile and outputting an image using the color profile in the image forming apparatus 100 according to the present embodiment will be described. The process of creating the color profile is performed by the printer controller 103. First, a profile creation instruction is input to a profile creation unit 301 via the operation unit 180. The profile creation unit 301 transmits a Cyan Magenta Yellow Black (CMYK) color chart of the test form of ISO 12642 to the image forming engine 102 so as to output the CMYK color chart without going through the profile. At the same time, a colorimetric instruction is sent to a color sensor control unit 302.

In the image forming apparatus 100, the test form of ISO 12642 is transferred and fixed to the sheet 1 as a patch image 1P by a process such as charging, exposure, development, transfer, and fixing, and color measurement is performed by the color sensor 200 of the color measurement unit 500. The spectral reflectance data of color measured 928 patches is input to the printer controller 103 and converted into L*a*b* data via a Lab calculation unit 303. Then, the L*a*b* data is stored as a color setting table in an input ICC profile storage unit for color sensor 304, and is input to the profile creation unit 301. Instead of L*a*b* data, the spectral reflectance data may be converted into the CIE1931XYZ color system, which is a color space signal independent of the device.

Furthermore, the profile creation unit 301 creates an output ICC profile based on the relationship between the output CMYK signal and the input L*a*b* data, and performs update to replace the output ICC profile stored in an output ICC profile storage unit 305.

The test form of ISO 12642 includes CMYK color signal patches covering a color reproduction range that can be output by a general copying machine, and creates a color conversion table from a relationship between each color signal value and a color measured L*a*b* value. That is, a conversion table (A2Bx tag) of CMYK→Lab is created. An inverse transformation table (B2Ax tag) is created based on this conversion table.

The ICC profile has a structure as illustrated in FIG. 4, and includes a header, a tag, and data thereof. In the tag, not only the color conversion table described above but also a white point (Wtpt), a (gamt) tag that describes whether a certain color expressed by an L*a*b* value defined in the profile is inside or outside a reproducible reproduction range of the hard copy, and the like are described.

Note that if the profile creation command is an input from the I/F 308 of an external device or the like, the output ICC profile created by the external device that transmitted the command may be uploaded, and the user may perform color conversion in an application corresponding to the ICC profile.

In color conversion in normal color output, an image signal input on the assumption of an RGB signal value input via an external OF 308 such as a scanner unit or a standard printed CMYK signal value such as Japanese Color is sent to an input ICC profile storage unit 307. In the input ICC profile storage unit 307, RGB→L*a*b* or CMYK→L*a*b* conversion is performed according to an image signal input from the external I/F 308. The input ICC profile includes a one-dimensional lookup table (LUT) that controls the gamma of the input signal, a multi-order color LUT called direct mapping, and a one-dimensional LUT that controls the gamma of the generated conversion data. The device-dependent color space is converted into device-independent L*a*b* data by using these tables.

The image signal converted into the L*a*b* chromaticity coordinates is input to a color management module (CMM) 306. Then, GAMUT conversion for mapping a mismatch between the read color space of the external I/F 308 such as the scanner unit as the input device and the output color reproduction range of the image forming apparatus 100 as the output device is performed. Furthermore, color conversion, black character determination, and the like for adjusting a light source type mismatch (also referred to as a mismatch of color temperature setting) when observing a light source type at the time of input and an output are also performed. As a result, the L*a*b* data is converted into L*'a*'b*' data and is input to the output ICC profile storage unit 305. The profile created as described above is stored in the output ICC profile storage unit 305, color-converted by the newly created ICC profile, converted into a CMYK signal depending on the output device, and output.

The configuration in which the CMM 306, the input ICC profile storage unit 307, and the ICC output profile storage unit 305 are separated from each other has been described in terms of the block configuration. However, as illustrated in FIG. 5, the CMM is a module that manages color management, and is a module that performs color conversion using an input profile and an output profile.

The maximum density condition determination unit 318, the gradation correction table generation unit 316, and the multi-order color table generation unit 317 reflecting the correction results of the multi-order colors manage and update the ICC profile, the γLUT, and the Vcont information used at the time of image formation. That is, it is possible to output a desired color by changing (reflecting) each table by the color processing unit 315, the multi-order color table generation unit 317, and the like.

Operation of Colorimetric Job

Figure 6:
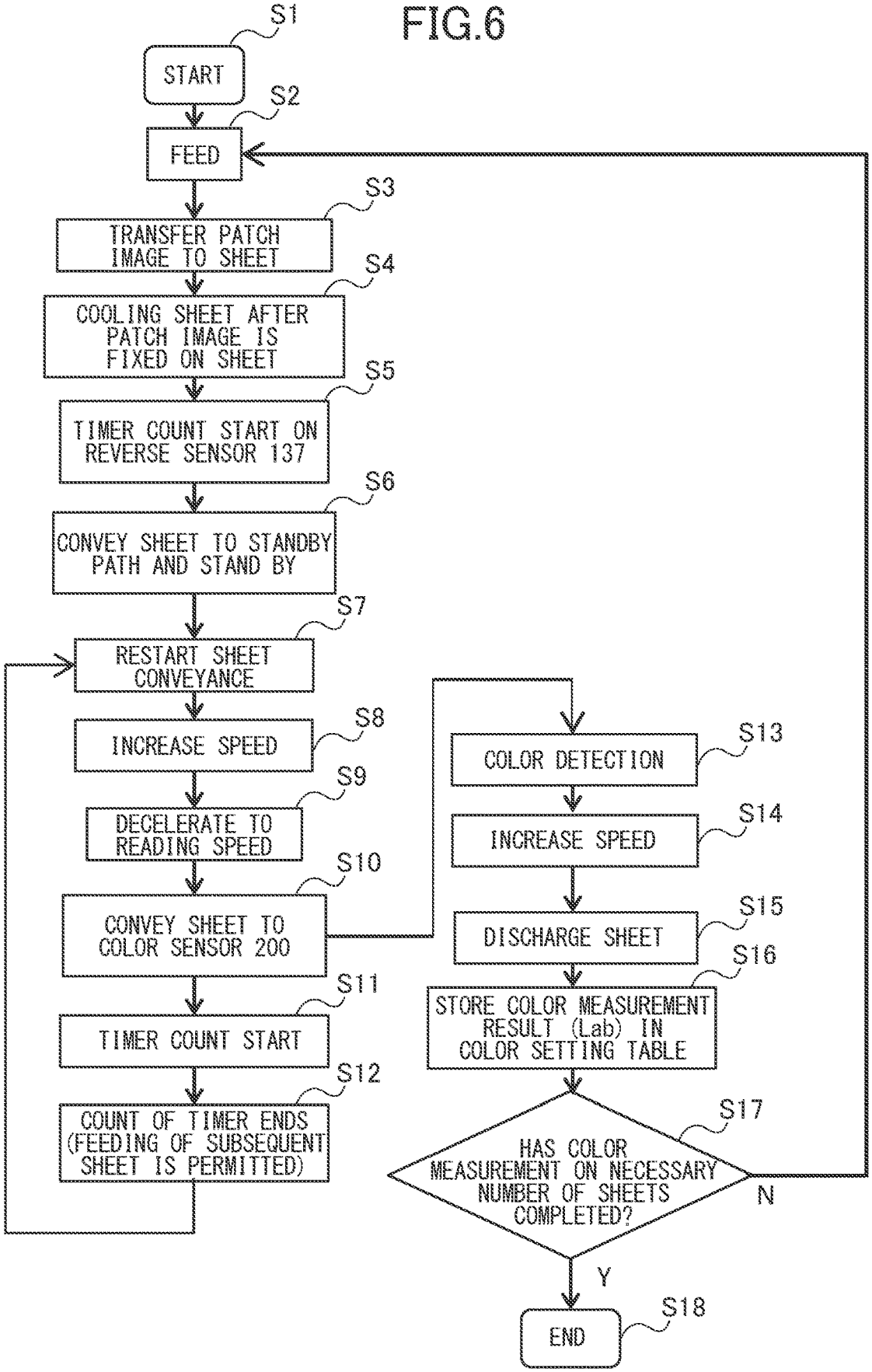
FIG. 6 is a flowchart illustrating control of a colorimetric job according to the present embodiment.
Figure 7:
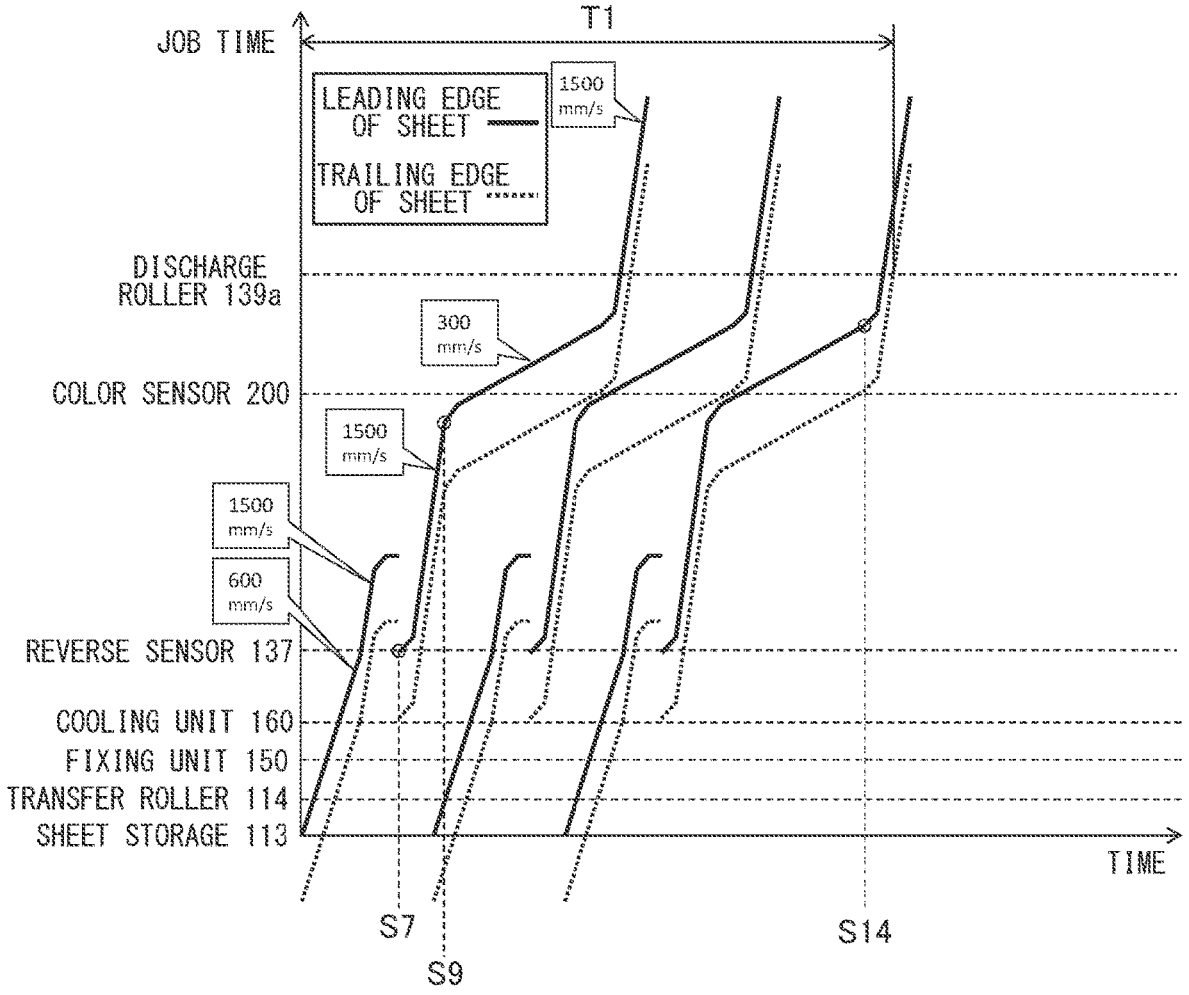
FIG. 7 is a diagram of sheet conveyance in a colorimetric job according to the present embodiment.

Next, control of a colorimetric job, which is an adjustment process of performing color adjustment in the present exemplary embodiment, and a conveyance state of a plurality of sheets in the colorimetric job will be described with reference to FIGS. 6 and 7. FIG. 6 is a flowchart illustrating control of the colorimetric job according to the present embodiment, and FIG. 7 is a diagram of sheet conveyance in the colorimetric job according to the present embodiment. Note that, FIG. 7 illustrates the position of each sheet 1 when, for example, three consecutive sheets 1 are conveyed when a colorimetric job is executed.

For example, when a colorimetric job such as color profile creation is designated from the operation unit 180 by a user operation, the printer controller 103 starts the control illustrated in FIG. 6 (S1). As illustrated in FIGS. 6 and 7, first, the feeding operation of the sheet 1 is started, and the sheet 1 is fed from the sheet storage 113 toward the transfer roller 114 (S2). On the other hand, in the image forming engine 102, a toner image of a test form is formed on the intermediate transfer belt 106, and is transferred to the fed sheet 1 as a patch image 1P for creating a color profile (S3). Then, after the patch image is fixed by the fixing unit 150, the sheet is cooled by the cooling unit 160 (S4), and the image formation is completed. At this time, the sheet 1 is conveyed through the transfer roller 114, the fixing unit 150, and the cooling unit 160 at a conveyance speed of 600 mm/sec as an image forming process speed.

Thereafter, when the trailing edge of the sheet 1 passes through the cooling unit 160, the sheet 1 is conveyed toward the pre-reverse conveyance path 133, the reversing conveyance path 135, and the standby path 138 at a conveyance speed increased to 1500 mm/sec (first conveyance speed) as a reverse drawing speed. After the leading edge of the sheet 1 passes through the reverse sensor 137, timer counting corresponding to the length of the sheet 1 is started (S5). Then, when the timer becomes 0, the trailing edge of the sheet 1 is located beyond the second switching flapper 134, and thus the conveyance of the sheet 1 is stopped, that is, the sheet 1 is conveyed to the reversing conveyance path 135 and the standby path 138, and the sheet is made to stand by (S6).

Subsequently, the first reverse conveyance roller 171 reverses the conveyance direction of the sheet 1 once stopped in the reversing conveyance path 135 and the standby path 138, and the second switching flapper 134 restarts the conveyance toward the post-reverse conveyance path 141 (S7, see FIG. 7). At that time, the conveyance speed is increased (S8), and the sheet is conveyed to the position of the color sensor 200 of the color measurement unit 500 at a conveyance speed of 1500 mm/sec as a post-reverse speed. Then, immediately before the leading edge of the sheet 1 reaches the reading position of the color sensor 200, the conveyance speed is decelerated to 300 mm/sec (second conveyance speed) as the reading speed (S9), and the sheet 1 is conveyed to the color sensor 200 at this speed (S10).

At this time, the timer count for determining the conveyance start timing of the subsequent sheet 1 is started (S11), and the timing at which the interval between the leading edge of the subsequent sheet 1 and the trailing edge of the preceding sheet 1 becomes as small as possible is measured at the reading position of the color sensor 200. Then, when the count of the timer ends, feeding of the subsequent sheet 1 is permitted (S12). When there is no subsequent sheet 1 (Y in S17 to be described later), only the flag for permitting the feeding is turned on, and the feeding is not actually performed.

On the other hand, when the sheet 1 is conveyed to the reading position of the color sensor 200, color detection (colorimetry) of the patch image 1P is performed by the reading operation of the color sensor 200 (S13). When the reading by the color sensor 200 is completed up to the rear end of the patch image 1P drawn on the sheet, the conveyance speed is increased to a conveyance speed of 1500 mm/sec which is a sheet discharge speed in order to discharge the sheet 1 quickly (S14). Then, the sheet 1 is discharged to the discharge tray 700 by the discharge roller 139*a* (S15). The color measurement result obtained by reading the patch image 1P is transmitted to the Lab calculation unit 303, converted into L*a*b* data, stored as a color setting table in the input ICC profile storage unit for color sensor 304, and input to the profile creation unit 301 (S16).

As described above, when the reading operation of the patch image 1P on the preceding sheet 1 ends, it is determined whether the color measurement of the necessary number of sheets has been completed (S17), that is, it is determined whether the color measurement of 928 patches necessary for creating the color profile has been completed. When the color measurement of the 928 patches necessary for the color profile creation is not completed (N in S17), the feeding of the subsequent sheet 1 is started. As a result, a continuation of the patch that has not been subjected to color measurement is formed on the subsequent sheet 1, and the same reading operation is performed on the subsequent sheet 1. Then, when the color measurement of 928 patches necessary for creating the color profile has been completed (Y in S17), the control is ended (S18), that is, the colorimetric job is completed.

Summary of Present Embodiment

In the present embodiment, as described above, the color sensor 200 is disposed along the post-reverse conveyance path 141 connecting the standby path 138 to the discharge conveyance path 139. Then, the timing of feeding the sheet 1 is controlled such that the leading edge of the subsequent sheet 1 is conveyed to the reading position of the color sensor 200 at the timing when the trailing edge of the preceding sheet 1 passes through the reading position of the color sensor 200. At this time, as illustrated in FIG. 7, while the preceding sheet 1 is being read by the color sensor 200, the subsequent sheet 1 is conveyed to the reversing conveyance path 135. As a result, it is possible to bring the trailing edge of the preceding sheet 1 and the leading edge of the subsequent sheet 1 close to each other at the reading position of the color sensor 200. Therefore, as illustrated in FIG. 7, the job time T1 from the start to the end of the job can be minimized, that is, it is possible to prevent the time of the colorimetric job from becoming long.

Further, when the images of the plurality of sheets 1 are read, the reading accuracy is not impaired by making the reading speed, which is the conveyance speed of the sheet, slower than the reverse drawing speed, the post-reverse speed, and the discharge speed. Furthermore, for example, when the sheet 1 is conveyed to the re-conveyance path 140 and a reading operation is performed in the re-conveyance path 140, the sheet 1 is conveyed to the discharge conveyance path 139 after passing through the transfer roller 114, the fixing unit 150, and the cooling unit 160 again, and thus, the conveyance time becomes long. However, in the present embodiment, since the sheet 1 can be immediately conveyed from the post-reverse conveyance path 141 to the discharge conveyance path 139, it is possible to prevent the time of the colorimetric job of reading the images of the plurality of sheets 1 from becoming long. Therefore, the time of the colorimetric job as the adjustment process can be shortened, and productivity can be improved. In other words, it is possible to provide an image forming apparatus having high color stability and a high operation rate.

First Comparative Example

Figure 8:
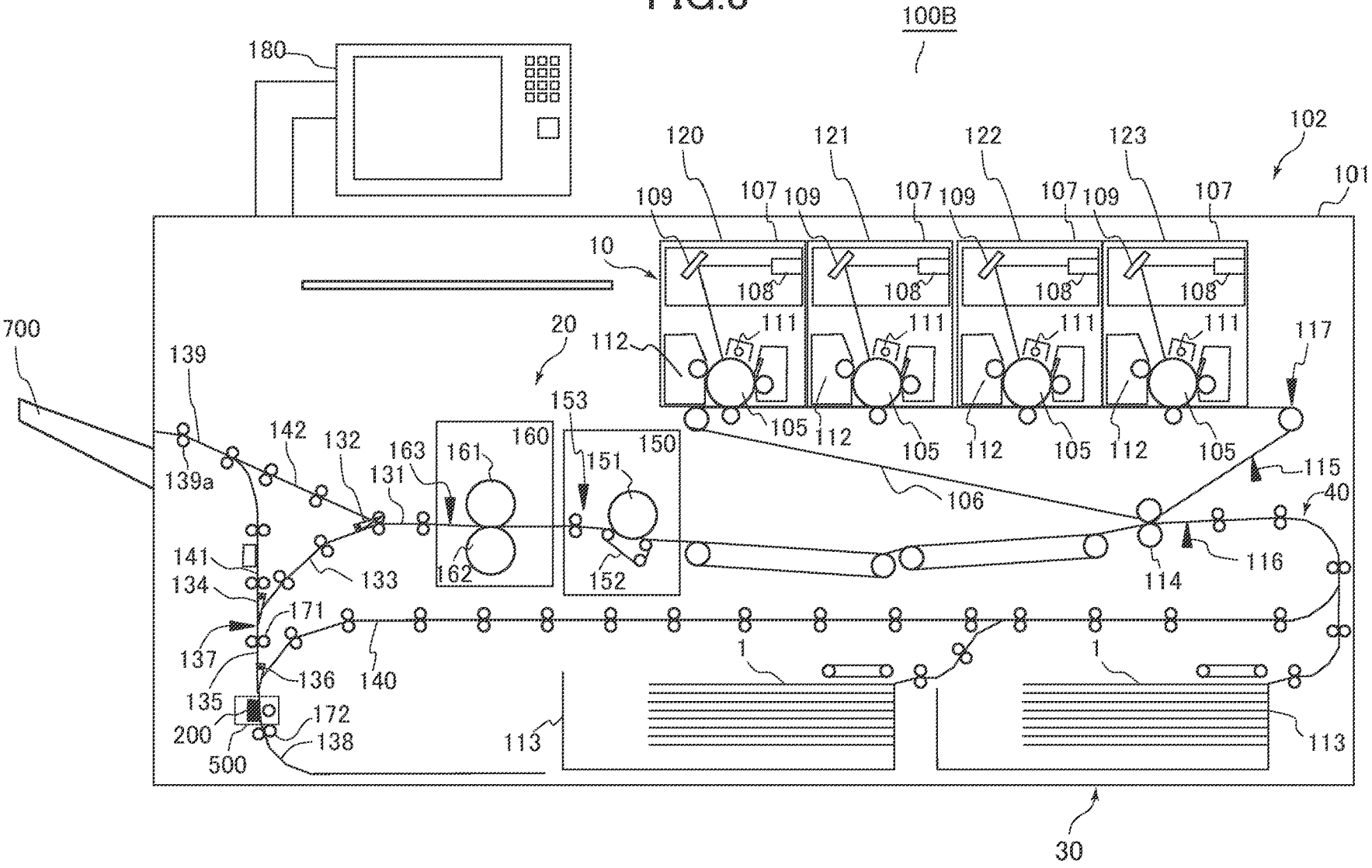
FIG. 8 is a schematic diagram of an image forming apparatus according to a first comparative example.
Figure 9:
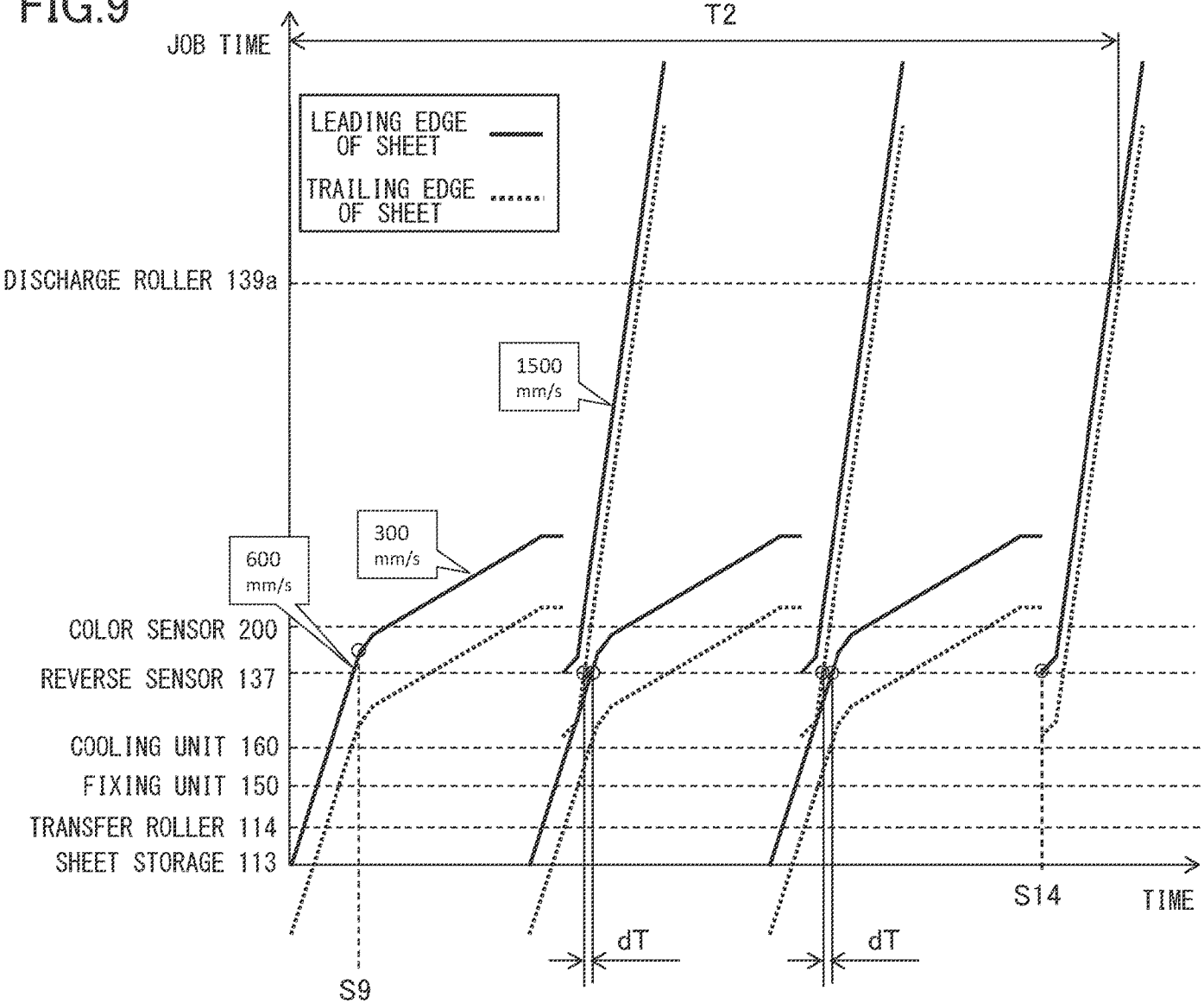
FIG. 9 is a diagram of sheet conveyance in a colorimetric job according to a first comparative example.

Next, the present embodiment and the first comparative example will be compared, and it will be described that the time of the colorimetric job in the present embodiment is shortened. FIG. 8 is a schematic diagram of an image forming apparatus according to the first comparative example, and FIG. 9 is a diagram of sheet conveyance in a colorimetric job according to the first comparative example.

As illustrated in FIG. 8, in the first comparative example, the color measurement unit 500 (the color sensor 200) is arranged downstream of the third switching flapper 136 in the sheet conveyance direction before reversal, that is, arranged near the entrance of the standby path 138. Therefore, by conveying the sheet 1 to the standby path 138, it is possible to read all the patch images 1P of the sheet 1.

However, the assumed length of the sheet 1 in the conveyance direction is a length at which the leading edge of the sheet 1 reaches the reading position of the color sensor 200 before the trailing edge of the sheet 1 passes through the cooling unit 160. Therefore, as described above, after the trailing edge of the sheet 1 passes through the cooling unit 160, a conveyance speed cannot be increased to the conveyance speed of 1500 mm/sec, which is the reverse drawing speed.

Furthermore, the timing at which the conveyance speed is decelerated from 600 mm/sec, which is the image forming process speed, to 300 mm/sec, which is the reading speed, is immediately before the leading edge of the sheet 1 reaches the reading position of the color sensor 200 (S9).

Therefore, the timing at which the reading of the patch image 1P of the first sheet 1 is completed is earlier than that in the present embodiment. However, in order to convey the subsequent sheet 1 to the color sensor 200, it is necessary to convey the subsequent sheet 1 after the trailing edge of the preceding sheet 1 passes through the second switching flapper 134 so that there is no collision between sheets. Therefore, the start of the reading operation of the subsequent sheet 1 is delayed by the time difference dT illustrated in FIG. 9. For these reasons, the job time T2 (see FIG. 9) required to complete the colorimetric jobs of the plurality of sheets 1 in the first comparative example is slower than the job time T1 (see FIG. 7) in the present embodiment.

Second Comparative Example

Figure 10:
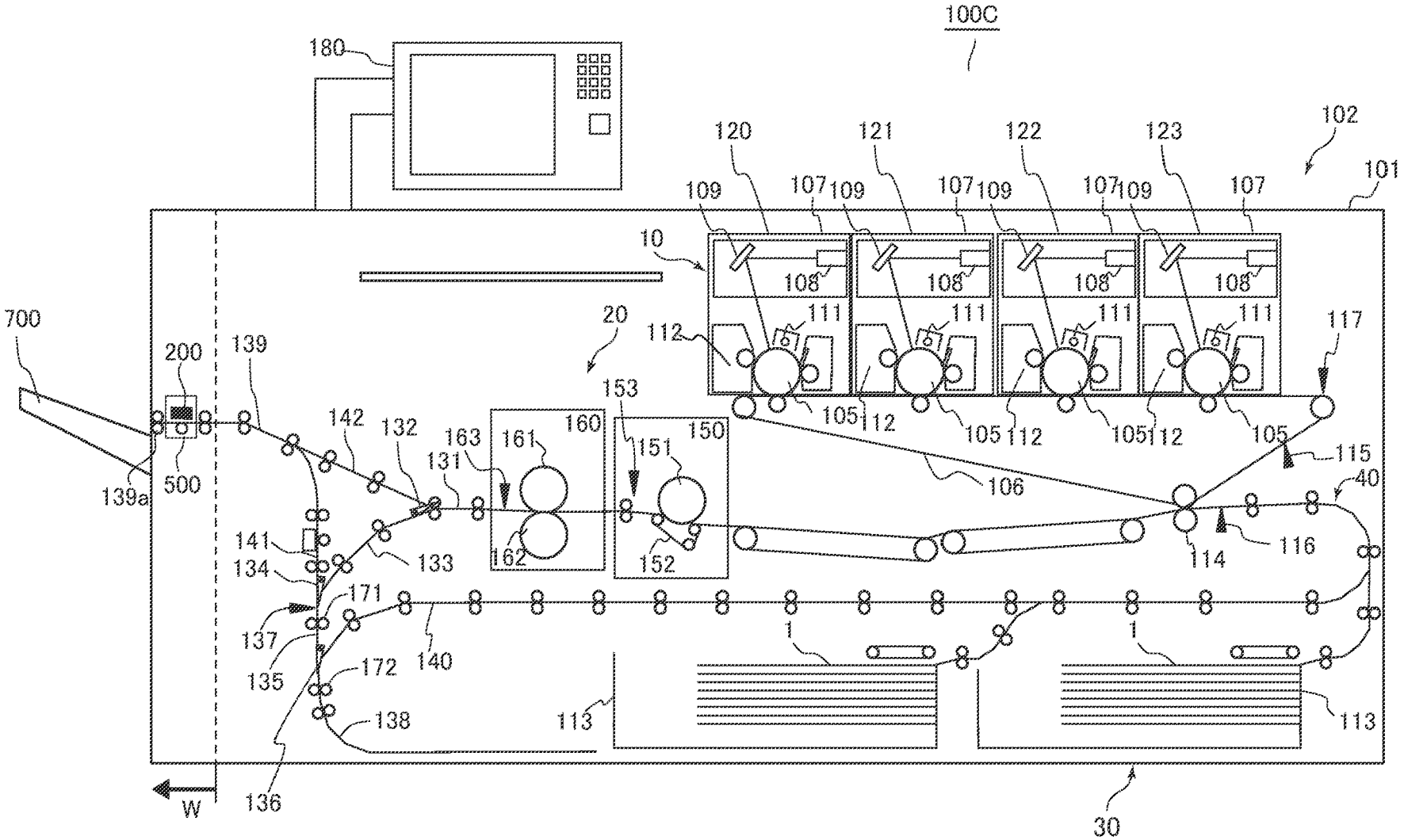
FIG. 10 is a schematic diagram of an image forming apparatus according to a second comparative example.

Next, a second comparative example will be described with reference to FIG. 10. FIG. 10 is a schematic diagram of an image forming apparatus according to the second comparative example.

As illustrated in FIG. 10, in the second comparative example, the color measurement unit 500 (the color sensor 200) is arranged along the discharge conveyance path 139 on the upstream of the discharge roller 139*a* in the sheet conveyance direction. In the second comparative example, the sheet 1 does not need to be drawn into the pre-reverse conveyance path 133, the reversing conveyance path 135, and the post-reverse conveyance path 141 in the first place, and it is sufficient to convey the sheet to the pre-discharge conveyance path 142 and the discharge conveyance path 139. However, the sheet 1 needs to be conveyed at a conveyance speed of 600 mm/sec, which is the image forming process speed, until the trailing edge of the sheet 1 passes through the cooling unit 160. However, on the other hand, it is necessary to decelerate the conveyance speed to 300 mm/sec, which is the reading speed, so as not to impair the reading accuracy of the patch image 1P. Therefore, it is necessary to lengthen the discharge conveyance path 139 (or the pre-discharge conveyance path 142) so that the leading edge of the sheet 1 reaches the reading position of the color sensor 200 after the trailing edge of the sheet 1 passes through the cooling unit 160. Therefore, the width of the image forming apparatus 100 increases as indicated by an arrow W. Therefore, the image forming apparatus 100 according to the present embodiment can be downsized as compared with the second comparative example.

Possibility of Other Embodiments

In the present embodiment, the image forming apparatus using a spectral color sensor as the color sensor has been described. However, a compact image sensor represented by a contact image sensor (CIS) may be used as the reading unit. Even in this case, since it is necessary to decelerate the conveyance speed at the time of image reading in order to secure the reading accuracy, the same control is performed for the colorimetric job of reading a plurality of sheets.

Further, in the present embodiment, the image forming apparatus including the re-conveyance path 140 has been described, but the re-conveyance path 140 may not be provided in an image forming apparatus that performs single-sided printing exclusively. Furthermore, in the present embodiment, the image forming apparatus including the pre-discharge conveyance path 142 has been described, but in an image forming apparatus that always reverses and discharges a sheet, the pre-discharge conveyance path 142 may not be provided.

Furthermore, in the present embodiment, the image forming apparatus of which the patch image including a large number of color patches has been described, but calibration may be performed by reading a black and white patch image.

In the present embodiment, the image forming apparatus of which the reading speed is slower than the image forming process speed has been described. However, the speed relationship may be any speed relationship as long as the image can be accurately formed and the reading accuracy can be maintained.

In the present embodiment, the image forming apparatus of which the sheet 1 is reversed by the first reverse conveyance roller 171 in the colorimetric job has been described, but the present invention is not limited thereto, and the sheet 1 may be reversed by the second reverse conveyance roller 172.

According to the present invention, by slowing the conveyance speed of the sheets when reading the images of the plurality of sheets, it is possible to prevent the time of the process of reading the images of the plurality of sheets from becoming long without deteriorating the reading accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-67582, filed Apr. 13, 2021, which is hereby incorporated by reference herein in its entirety.

What is claimed is:

1. An image forming apparatus comprising:

an image forming unit configured to form an image on a sheet;

a discharge conveyance path configured to discharge the sheet on which the image is formed by the image forming unit to outside;

a reverse conveyance path configured to reverse a conveyance direction of the conveyed sheet and convey the sheet;

a first conveyance path configured to guide the sheet conveyed from the image forming unit to the reverse conveyance path;

a second conveyance path configured to guide the sheet reversed in the reverse conveyance path in only one direction, from the reverse conveyance path to the discharge conveyance path;

a switching unit configured to switch between conveyance of the sheet from:

the first conveyance path to the reverse conveyance path; and the reverse conveyance path to the second conveyance path; and a reading unit provided on the second conveyance path and configured to read the image of the sheet conveyed from the reverse conveyance path to the second conveyance path through the switching unit.

2. The image forming apparatus according to claim 1, further comprising:

a third conveyance path configured to guide the sheet in the reverse conveyance path to the image forming unit; and another switching unit configured to switch a conveyance path of the sheet in the reverse conveyance path between the third conveyance path and the second conveyance path.

3. The image forming apparatus according to claim 2, further comprising:

a fourth conveyance path configured to guide the sheet conveyed from the image forming unit to the discharge conveyance path; and a yet another switching unit configured to switch a conveyance path of the sheet conveyed from the image forming unit between the first conveyance path and the fourth conveyance path.

4. The image forming apparatus according to claim 1, further comprising a control unit configured to:

control the image forming unit to form test images on a plurality of sheets continuously conveyed, control the reading unit to read the test images on the plurality of sheets continuously conveyed, and correct an image to be formed on a sheet by the image forming unit based on the read test images.

5. The image forming apparatus according to claim 4, wherein:

the image forming unit is configured to form the test images in color, and the reading unit includes a color sensor that reads colors of the test images.

6. The image forming apparatus according to claim 1, further comprising a control unit configured to control a conveyance speed of the sheet to a second conveyance speed in a state where the reading unit reads images of a plurality of sheets continuously conveyed, the second conveyance speed being lower than a first conveyance speed, which is a conveyance speed in the first conveyance path.

7. The image forming apparatus according to claim 6, wherein the control unit is configured to control the second conveyance speed to be lower than an image forming process speed at which an image is formed on the sheet in the image forming unit.

8. The image forming apparatus according to claim 6, wherein the control unit is configured to convey the sheet at the second conveyance speed while reading an image of the sheet for conveying the sheet in the second conveyance path.

9. The image forming apparatus according to claim 1, wherein, while a first sheet is being read by the reading unit, a second sheet, which is to be read by the reading unit after the first sheet, is configured to reach the reverse conveyance path.

* * * * *